United States Patent [19]

Spain

[11] 4,007,658

[45] Feb. 15, 1977

[54] STRING MOUNTING AND ADJUSTMENT FOR STEEL GUITARS

[76] Inventor: Harold T. Spain, 1900 Ridgemont Road, Richmond, Va. 23224

[22] Filed: Aug. 29, 1975

[21] Appl. No.: 608,981

[52] U.S. Cl. ..... 84/312

[51] Int. Cl.[2] ..... G10D 3/14

[58] Field of Search ..... 84/312, 284, 285, 297, 84/313

[56] References Cited

UNITED STATES PATENTS

| | | | |
|---|---|---|---|
| 3,422,716 | 1/1969 | Alifano | 84/312 |
| 3,447,413 | 6/1969 | Lashley | 84/312 |

*Primary Examiner*—Lawrence R. Franklin
*Attorney, Agent, or Firm*—Griffin, Branigan & Butler

[57] ABSTRACT

In a steel guitar of the type having strings mounted on levers located at opposite ends of the guitar, the strings are attached to the levers by tuning pegs at alternating ends of the strings. Linkage between foot pedals and the levers includes rocker arms having adjustable stops thereon so that the ranges of the levers' movements can be selectively set. Adjustable stops are also included at the levers.

8 Claims, 6 Drawing Figures

STRING MOUNTING AND ADJUSTMENT FOR STEEL GUITARS

BACKGROUND OF THE INVENTION

This invention relates generally to the art of steel guitars and more particularly to steel guitars having strings mounted on levers of the type disclosed in U.S. Pat. No. 3,748,943 to Lashley.

The Lashley patent discloses a steel guitar wherein strings are attached to levers located at opposite ends of the guitar. The strings extend over rounded portions of the levers at the levers' pivots. The levers are pivoted by pedals to control the tensions of the strings while they are being played. The strings are attached to levers located at one end of the instrument by means of followers which are mounted on screws for movement longitudinal of the levers. The screws are rotated to move the followers and tune their attached strings. Lashley does not use conventional tuning pegs because his string-mounting levers do not allow sufficient room to conveniently mount tuning pegs on them in the normal manner.

Although Lashley's steel guitar has many advantages over conventional steel guitars, it has a significant disadvantage in that a special tool must be used to rotate the screws for tuning the strings. This is a great disadvantage in that musicians often must tune their instruments while performing and do not have time to reach for a tool in order to accomplish such tuning.

Thus, it is an object of this invention to provide a steel guitar having lever mounted strings wherein the strings thereof are mounted on the levers by tuning pegs which can be quickly hand gripped and rotated for tuning. It is a further object of this invention to provide such a steel guitar that is uncomplicated in structure and not unduly expensive to manufacture.

Another difficulty with Lashley's steel guitar is that the ranges of movement of its string mounting levers, and the linkages to the levers, are relatively difficult to adjust. It is therefore yet another object of this invention to provide appropriate mechanisms for selectively controlling the ranges of movement of levers in a steel guitar of the type described above.

BRIEF DESCRIPTION OF THE DRAWINGS

The foregoing and other objects, features and advantages of the invention will be apparent from the following more particular description of a preferred embodiment of the invention as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
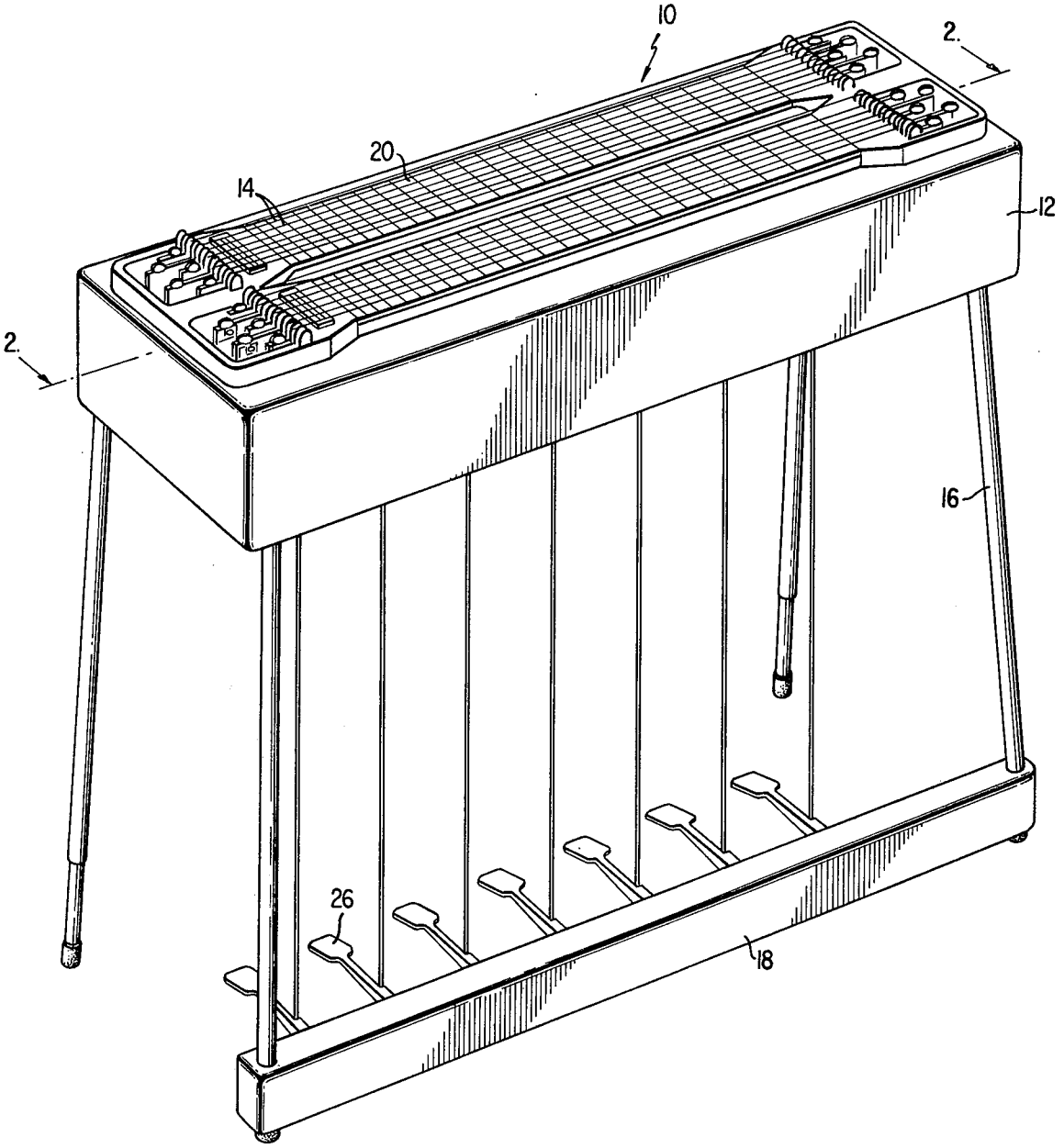
FIG. 1 is an isometric view of a steel guitar employing principles of this invention.

Referring first to FIG. 1, a musical instrument, or steel guitar 10 includes a metal frame 12, strings 14, and string-mounting and tensioning apparatus which will be described in greater detail below. The metal frame 12 includes legs 16, a pedal support 18 and a fret board 20.

The string-mounting and tensioning apparatus is described with reference to FIGS. 2–6. Basically, it includes left and right string-mounting levers 22*a*,*b*, and 24*a*,*b*, pedals 26 and appropriate linkage for actuating the left and right string mounting levers 22*a*,*b*, by pressing the pedals 26.

There are two types of string-mounting levers 22*a*,*b*, and 24*a*,*b*. Firstly, there are tuning peg string-mounting levers 22*a* and 24*a*, each of which include a rearwardly protruding portion 32 on which a tuning peg 34 is mounted. The tuning peg 34 is of conventional type, including a worm screw (not shown) attached thereto for driving a pinion 36 (FIG. 5) which tightens an attached string 14.

Secondly, there are simple left and right string mounting levers 22*b* and 24*b* which do not include tuning pegs, but rather merely have strings attached thereto by pins 38 or some other attaching device. It is noted that in similar situations, strings are held in slots by enlarged string end portions, and such an attaching combination would work in this situation as well.

Figure 2:
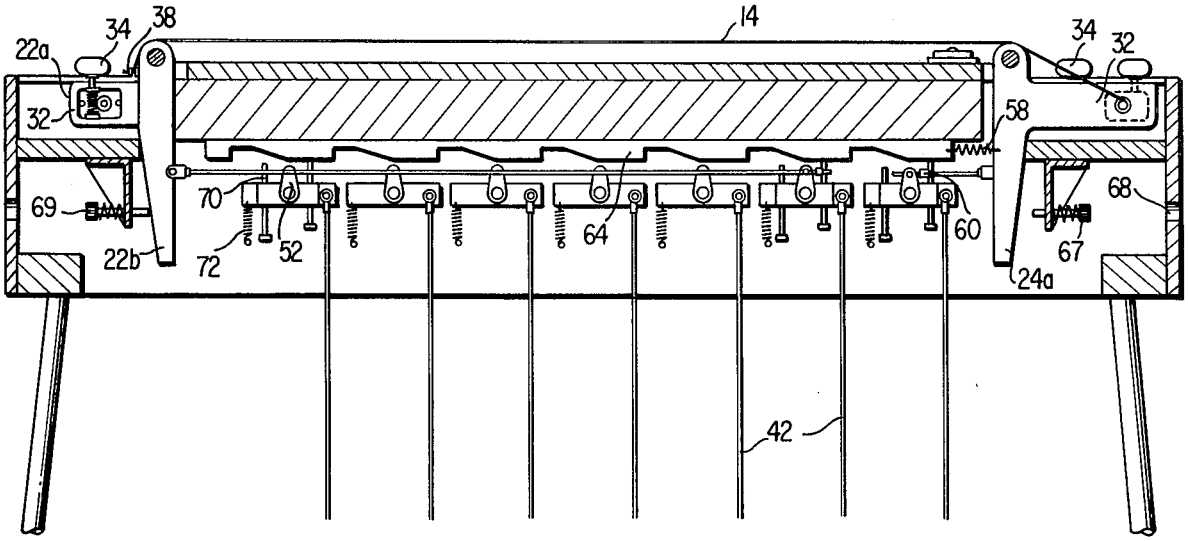
FIG. 2 is a sectional view taken on lines 2 — 2 in FIG. 1.

It should be particularly noted, that consecutive levers at an end of the musical instrument 10, the right end as seen in FIG. 2 for example, alternate between being a tuning peg string-mounting lever 24*a* and a simple string-mounting lever 24*b*. Similarly, as seen in FIG. 2, the first string-mounting lever at the left end of the instrument 10 is a simple string-mounting lever 22*b*, the next a tuning string-mounting lever 22*a*, the third a simple string-mounting lever (not shown in FIG. 2), and so on.

Also significantly, levers that are directly opposite one another at opposite ends of a string, are of opposite types. For example, again referring to FIG. 2, the first levers seen at opposite left and right ends are respectively a simple string-mounting lever 22*b* and a tuning-peg string-mounting lever 24*a*. A string 14 extends between these two levers. This can be even more clearly seen in FIG. 6 wherein opposite levers for mounting a string 14 are shown in isolation.

Describing next the linkage between the pedals 26 and the string-mounting levers 22*a*,*b*, and 24*a*,*b*, each of the pedals 26 is pivotally mounted by means of a mounting pin 40 (FIG. 4) to the pedal support 18 (FIG. 1) for pivotal movement thereabout. Intermediate the outer ends of the pedals 26 and their pivotal mounting, vertical rods 42 (FIGS. 1, 2 and 4) are pivotally attached thereto by means of swivel connectors 44. Each of the vertical rods is, in turn, pivotally attached to an outer end of a rocker arm 46 by means of a swivel connector 48. The rocker arms 46 are each fixedly attached to respective rocker arm shafts 50, which, in turn, are fixedly attached to respective linking levers 52. The ends of the linking levers 52 are slidably attached to horizontal linking rods 54 which have adjustable sleeves 56 that can be fixed therealong at desirable locations. The horizontal linking rods 54 are pivotally attached to either a left or a right string-mounting lever 22*a,b* or 24*a,b*.

Thus, when a pedal 26 is pushed downwardly, this motion is transmitted via a vertical rod 42 to rotate a rocker arm 46 which rotates a linking lever 52 via a rocker arm shaft 50. The linking lever 52 slides on the horizontal linking rod 54, until it hits an adjustable sleeve 56 which is affixed to the horizontal linking rod 54. At this point, the linking lever 52 moves the horizontal linking rod 54 longitudinally to rotate its attached string-mounting lever 22*a,b*, or 24. It can be seen in FIG. 2 that in some cases the levers are pulled by the horizontal linking rods 54 and in some cases they are pushed.

Figure 3:
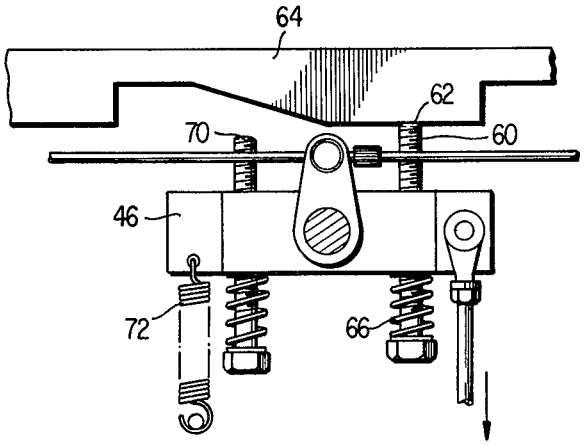
FIG. 3 is an isolated view of a rocker arm forming part of the linkage between a pedal and a string-mounting lever in the guitar of FIGS. 1 and 2.
Figure 4:
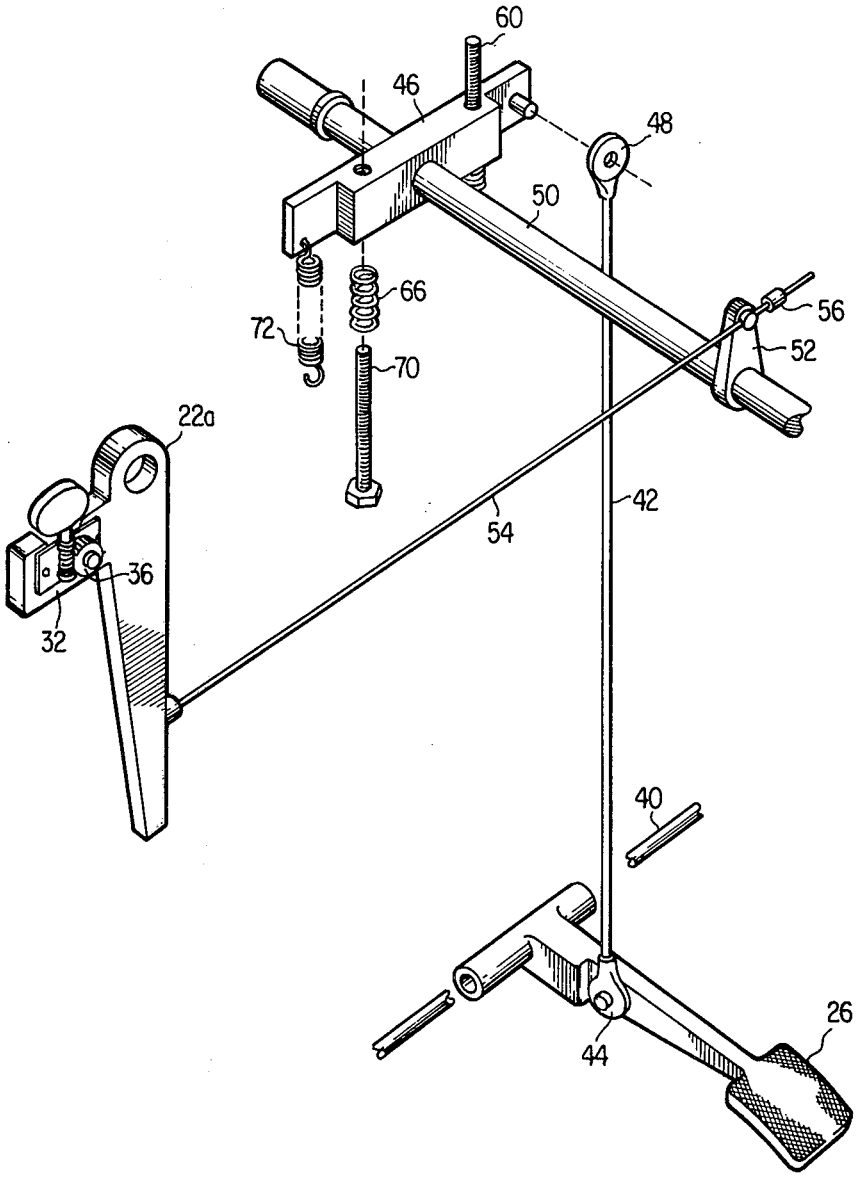
FIG. 4 is an isometric, partially-exploded view of the linkage between a pedal and a string-mounting lever in the guitar of FIGS. 1 and 2.
Figure 5:
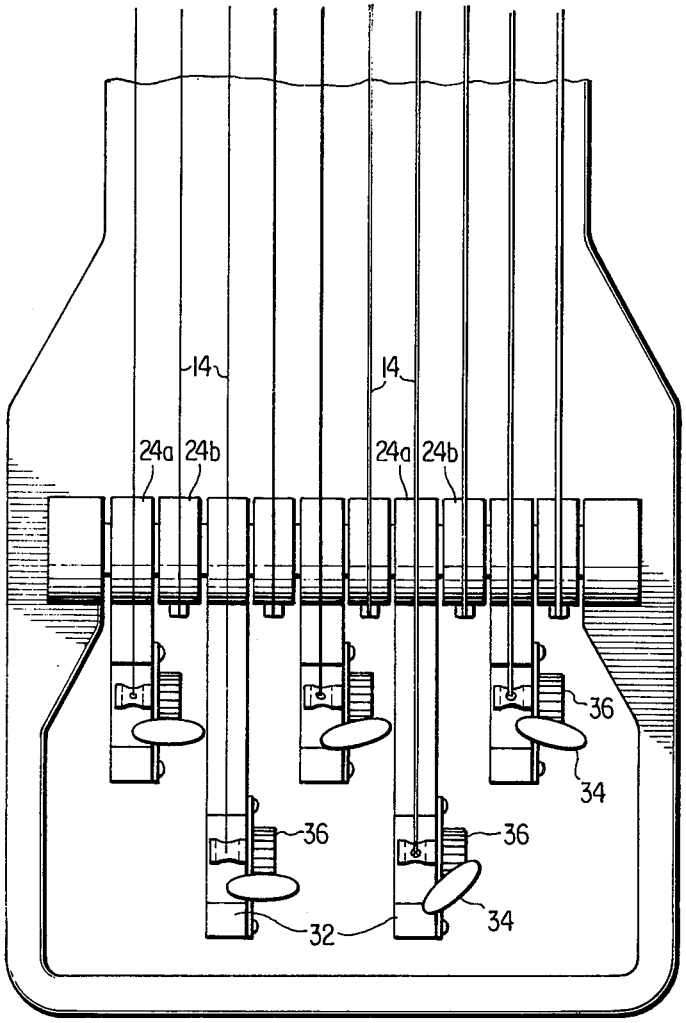
FIG. 5 is a top view of string mounting apparatus at one end of the musical instrument of FIGS. 1 and 2; and, FIG. 6 is a schematic side view of the mounting mechanism for one string of the musical instrument of FIGS. 1 and 2.
Figure 6:
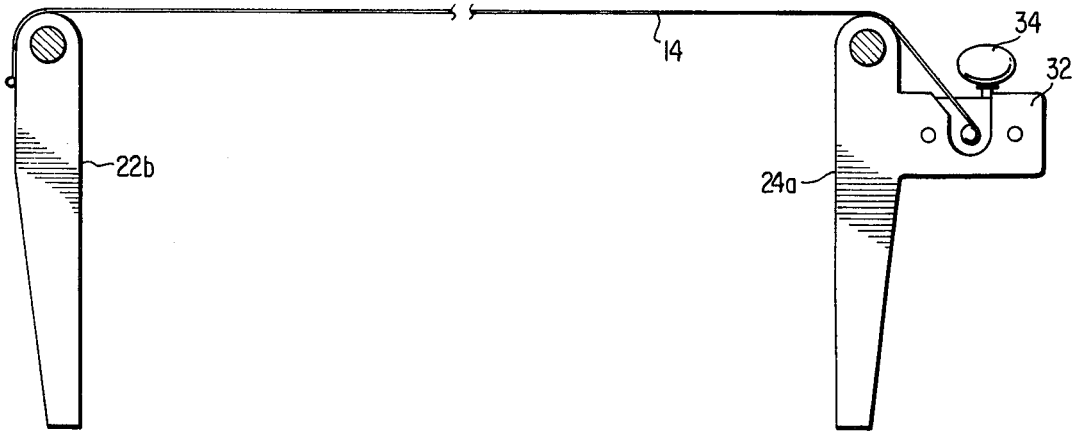

Biasing springs 58 (FIG. 2) bias the right string-mounting levers 24*a,b*, in clockwise directions, with the extent of this movement being determined by adjustable rocker-arm stops 60 (FIG. 3). The adjustable rocker-arm stops 60 are threaded bolts which are screwed through the rocker arms 46 so that their outer ends 62 make contact with a contoured rocker-arm cam 64 on the frame 12. The adjustable rocker-arm stops 60 can be easily screwed through the rocker arms 46 to determine the ranges of movement of their rocker arms. In this regard, springs 66 are mounted on the adjustable rocker arm stops 60 to prevent inadvertent rotation thereof to change their positions.

The extent of counterclockwise movement of the string-mounting levers 24 *a,b*, is determined by the positions of right adjustable lever stops 67 (FIG. 2). These stops comprise bolts which are screwed into the metal frame 12. In this regard, openings 68 are provided in the metal frame 12 so that access for turning these bolts can be attained. These bolts also have springs thereon to prevent inadvertent rotation thereof.

The left string-mounting levers 22*a,b*, are also biased in a clockwise direction, however, this biasing is accomplished by tension in the strings 14, and no additional spring is required. The clockwise extent of rotation of the left string-mounting levers 22*a,b*, is determined by the left adjustable lever stop 69, which is similar to the right adjustable lever stop 67 as is described above.

Counterclockwise rotation of the left string-mounting levers 22*a,b*, is limited by adjustable rocker arm stops 70 (FIG. 3). These rocker arm stops are similar to the adjustable rocker arm stops 60, however, they are located at opposite ends of the rocker arms 46 from the adjustable rocker arm stops 60.

It should be noted in FIG. 3 that the rocker arms 46 are biased in a counterclockwise direction by springs 72 to return them, and their linked pedals, to appropriate positions when their pedals are released.

In operation, a performer "strings" the musical instrument 10 by attaching strings 14 between simple and tuning-peg string-mounting levers 22*a,b* and 24*a,b*. The tuning pegs are tightened until the strings 14 are at appropriate tensions creating the normal notes of steel guitars. During tuning, the rocker arms 46 are retained in approximately horizontal positions, as depicted in FIG. 2, by their adjustable rocker arm stops 60. The left string-mounting levers 22*a,b*, are held in fixed positions by the left adjustable lever stops 69 and the right string-mounting levers 24*a,b*, are held in appropriate positions by the adjustable rocker arm stops 60.

While playing the steel guitar 10, a performer can depress any of the pedals 26 to selectively operate the left string-mounting levers 22*a,b*, thereby tightening attached strings 14, or the right string-mounting levers 24*a,b*, to thereby loosen attached strings 14 or combinations thereof. In the case of the left string-mounting levers 22*a,b*, these levers are rotated by pedals in a counterclockwise direction until the adjustable rocker arm stops 70 prevent further rotation. The adjustable rocker arm stops 70 are adjusted so that tensions of these strings are increased to produce appropriate specific higher notes than normal, for example, half tones or full tones higher. In the case of the right string-mounting levers 24*a,b*, these levers are rotated in a counterclockwise direction to loosen the strings 14 until the levers 24*a,b*, impinge on the right adjustable lever stops 67. The right adjustable lever stops 67 are adjusted so that the right string mounting levers are stopped in positions which produce appropriate specific lower notes with the strings 14 than normal, for example, half tones or full tones lower.

It should be appreciated by those skilled in the art, that positioning tuning pegs at opposite ends of a steel guitar for alternate strings solves the space problem that was discussed above in relation to the Lashley U.S. Pat. No. 3,748,943 but yet allows every string to be tuned by conventional tuning pegs during a performance.

It should also be appreciated by those skilled in the art, that the linkage described herein can be easily and quickly adjusted to provide desirable movement ranges of the string-mounting levers 22*a,b*, and 24*a,b*. In this respect, the left and right adjustable lever stops 69 and 67 can be used to easily adjust the outward distances of travel of the string-mounting levers 22*a,b*, and 24*a,b*, and the adjustable rocker-arm stops 70 and 60 can be used to set the inward travels of the levers.

As depicted in FIG. 2, only one pedal is used to control the right string-mounting levers 24*a,b*, and many pedals are used to control the left string-mounting levers 22*a,b;* however, this is for purposes of illustration only. In this regard, this application incorporates by reference all of the material in the Lashley U.S. Pat. No. 3,748,943 disclosing the environment in which this invention can be used.

While the invention has been particularly shown and described with reference to a preferred embodiment, it will be understood by those skilled in the art that various changes in form and detail may be made therein without departing from the spirit and scope of the invention. For example, knee controls could be used to pivot the string-mounting levers 22*a,b*, and 24*a,b*, rather than pedals. Also, one pedal can be used to control the tension of more than one string.

The embodiments of the invention in which an exclusive property or privilege is claimed are defined as follows:

1. In a steel guitar of the type comprising:

a plurality of parallel strings mounted thereon;

a string-mounting means for mounting and controlling the tensions of said strings comprising first and second string supporting and tensioning assemblies located at opposite ends of said steel guitar, each of said assemblies including elongated displaceable levers between which said strings extend, each lever including an arcuate portion over which an attached string passes, and a string securing means for attaching the end of said string to said lever; and a lever actuating means for adjustably displacing said levers to selectively vary the tensions of the strings attached to said levers;

the improvement wherein only one of said string securing means for each of said strings includes a rotatable tuning peg about which said string wraps, said tuning peg including a hand gripping portion which can be hand grasped and hand rotated for manual tuning, the rotatable tuning pegs being positioned at opposite ends of said steel guitar for adjacent strings.

2. In a musical instrument as claimed in claim 1 wherein said lever actuating means includes a manually-operated means, at least one elongated, axially displaceable rod attached to at least one lever, a rotatable shaft for selectively coupling said rod and said manually operated means, and means for rotating said shaft in response of said manually-operated means for selectively controlling displacement of said at least one lever, said rotatable shaft including an adjustable stop thereon for determining the range of rotation of said shaft in at least one direction and thereby determining the range of displacement of said at least one lever in a first pivotal direction.

3. In a musical instrument as in claim 2 wherein said musical instrument further includes a contoured cam located adjacent to said rotatable shaft for impinging on said adjustable stop.

4. In a musical instrument as in claim 1 wherein is further included an adjustable stop located adjacent to each of said levers for determining the movements of said levers in a second pivotal direction.

5. In a musical instrument as in claim 4 wherein said lever actuating means includes a manually operated means, at least one elongated, axially displaceable rod attached to at least one lever, a rotatable shaft for selectively coupling said rod and said manually operated means, and means for rotating said shaft in response to operation of said manually-operated means for selectively controlling displacement of said at least one lever, said rotatable shaft including an adjustable stop thereon for determining the range of rotation of said shaft and thereby determining the range of displacement of said at least one lever in a first pivotal direction.

6. In a musical instrument as in claim 1 wherein the levers on which said rotatable tuning pegs are mounted include protruding portions extending laterally from said levers said tuning pegs being mounted on said protruding portions, and said levers which do not have tuning pegs mounted thereon, are smooth along the lengths thereof.

7. In a steel guitar of the type comprising:

a plurality of parallel strings mounted thereon;

a string-mounting means for mounting and controlling the tension of said strings comprising first and second string supporting and tensioning means assemblies located at opposite ends of said steel guitar, each of said assemblies including elongated displaceable levers between which said strings extend, each lever including an arcuate portion over which an attached string passes, and a string securing means for attaching the end of said string to said lever; and a lever actuating means for adjustably displacing said levers to selectively vary the tensions of their attached strings, said displacing means including a manually operated means, at least one elongated, axially displaceable rod attached to at least one lever, a rotatable shaft for selectively coupling said rod and said manually operated means, and means for rotating said shaft in response to operation of said manually-operated means for selectively controlling displacement of said at least one lever, said rotatable shaft including an adjustable stop mounted thereon for determining the range of rotation of said shaft in at least one direction and thereby determining the range of displacement of said at least one lever in a first pivotal direction;

the improvement wherein only one of said string securing means for each of said strings includes a rotatable tuning peg about which said string wraps, said tuning peg including a hand gripping portion which can be hand grasped and hand rotated for manual tuning, the rotatable tuning pegs being positioned at opposite ends of said steel guitar for adjacent strings and wherein said steel guitar further includes a contoured cam located adjacent to said rotatable shaft for impinging on said adjustable stop.

8. In a musical instrument as claimed in claim 7 wherein is further included an adjustable stop located adjacent to said at least one lever for impinging on said lever to determine the movement of said lever in a second pivotal direction.

* * * * *